US012264441B2

(12) United States Patent
Reindl et al.

(10) Patent No.: US 12,264,441 B2
(45) Date of Patent: Apr. 1, 2025

(54) TEXTILE SLIDING SURFACE FOR SKI AND TOBOGGAN APPLICATIONS

(71) Applicant: Mr. Snow GmbH, Chemnitz (DE)

(72) Inventors: Jens Reindl, Leipzig (DE); Felix Neubert, Hirschfeld (DE)

(73) Assignee: Mr. Snow GmbH, Chemnitz (DE)

( * ) Notice: Subject to any disclaimer, the term of this patent is extended or adjusted under 35 U.S.C. 154(b) by 409 days.

(21) Appl. No.: 17/762,207

(22) PCT Filed: Sep. 21, 2020

(86) PCT No.: PCT/EP2020/076331

§ 371 (c)(1),
(2) Date: Mar. 21, 2022

(87) PCT Pub. No.: WO2021/053241

PCT Pub. Date: Mar. 25, 2021

(65) Prior Publication Data

US 2022/0372713 A1 Nov. 24, 2022

(30) Foreign Application Priority Data

Sep. 20, 2019 (DE) ..... 20 2019 105 243.0

(51) Int. Cl.
*E01C 13/12* (2006.01)
*D03D 27/06* (2006.01)

(52) U.S. Cl.
CPC ..... *E01C 13/12* (2013.01); *D03D 27/06* (2013.01); *D10B 2321/022* (2013.01); *D10B 2331/02* (2013.01); *D10B 2331/04* (2013.01)

(58) Field of Classification Search
CPC ..... D03D 27/00; D03D 27/06; D03D 27/10; E01C 13/12
USPC ..... 472/89, 90
See application file for complete search history.

(56) References Cited

U.S. PATENT DOCUMENTS

| | | | | |
|---|---|---|---|---|
| 2,737,702 | A * | 3/1956 | Schmidt | D04B 1/025 28/162 |
| 4,729,215 | A * | 3/1988 | Sato | D03D 27/00 57/227 |
| 6,962,042 | B2 * | 11/2005 | Barth | D04H 3/11 57/5 |
| 9,536,425 | B1 | 1/2017 | Soltesz et al. | |
| 2017/0300049 | A1 | 10/2017 | Seally | |

FOREIGN PATENT DOCUMENTS

| | | | |
|---|---|---|---|
| DE | 1950009 | A1 | 8/1970 |
| DE | 29512702 | U1 | 1/1996 |
| DE | 202011105370 | U1 | 11/2011 |
| DE | 102013014285 | A1 | 2/2015 |

(Continued)

*Primary Examiner* — Kien T Nguyen
(74) *Attorney, Agent, or Firm* — 24IP Law Group USA, PLLC; Timothy R. DeWitt

(57) ABSTRACT

Disclosed is a textile sliding surface with a functional layer (1) and a base layer (2), which are connected to each other by filament yarns. The functional layer (1) is formed of pile loops, whereby the height of the pile loops in the functional layer (1) has a height (4), depending on the sport, in the range 4-1 4 mm and the functional layer (1) has 400-2400 pile loops per $dm^2$. The yarns are bound into the base layer (2) in the lower part of the pile loops by W-bonds (10).

9 Claims, 1 Drawing Sheet

(56) References Cited

FOREIGN PATENT DOCUMENTS

Figure 1:
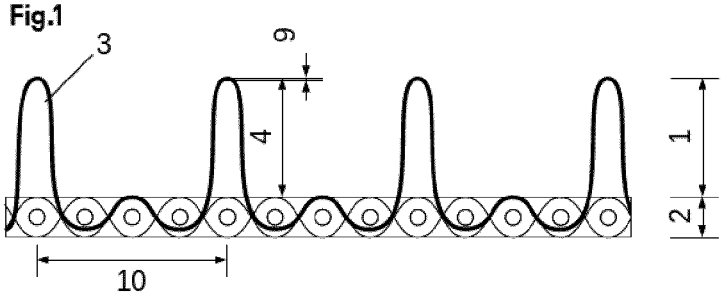

| | | | |
|---|---|---|---|
| DE | 102014000845 | A1 | 4/2015 |
| EP | 2258893 | A1 | 12/2010 |
| GB | 2457927 | A | 9/2009 |

* cited by examiner

TEXTILE SLIDING SURFACE FOR SKI AND TOBOGGAN APPLICATIONS

The invention relates to a textile sliding surface for skiing and tobogganing applications, which comprises a base layer and a functional layer and thus forms a mat. This mat has snow-like sliding properties on the surface of the functional layer.

In addition, the structure of the functional layer offers largely uniform guiding properties in the ski application case and thus enables use with various winter sports equipment, such as skis, snowboards, etc.

The trapability as well as closed surface with a low loop height in the functional layer enables use for toboggan applications.

Skiing is also possible with the low loop height for applications that require no or very little edge grip. This applies, among other things, to classic cross-country skiing and ski jumping.

The sliding surface enables these applications all year round and thus independent of snow and temperature.

Due to its properties, it can also be used in other friction-critical applications, for example conveyor technology, also in the form of a treadmill.

Known so far are plastic mats for ski jumps and injection-molded sliding mats (e.g., from the companies Neveplast or Skitrax), which only show good properties in combination with a separate sliding fluid. Due to their open structure, these products pose a risk of injury. Alternatively, various types of artificial turf are used, but these have very poor sliding properties.

DE 10 2014 000845 describes a textile laminate with a sliding surface. The sliding layer of this patent application comprises a fabric which has 100-950 pile loops or pile tufts per $dm^2$ with a height of 3-10 mm. The fabric can be provided with a back coating. The modules made of these fabrics are fixed in the ground by means of lugs and ground nails. The modules are connected to each other by gluing, welding, sewing or bonding. The loops, which can be made of various synthetic materials, have a fineness of 5,000-30,000 dtex.

DE 10 2013 014285 describes a laminated composite with a sliding surface. The sliding layer consists of floating warp threads with a floating length of 3-100 mm. The warp threads can be so close together that an almost closed surface is created as a sliding surface. The ridges and grooves created by the floatation have a width dimension, transverse to the direction of travel, of 2-5 mm. The warp threads themselves have an outer diameter of 1-6 mm.

With these known fabrics or mats, the following disadvantages are to be expected when using them as textile ski or toboggan slopes:

- High production and joining costs
- Difficult connection of the individual modules
- Direction-dependent properties in the edge behavior; limited edge capability
- Direction-dependent properties in gliding behavior, for example in bob-like steep curves
- hard surface
- Risk of injury due to the protrusion of the thick and long floating monofilaments, in
- case they break and thus stick upwards.

For the application as a ski slope, according to the solutions and production possibilities known so far, the disadvantage has arisen that the properties of the sliding surface, especially in the edge behavior of the ski, are direction-dependent. This directional dependency results from the small number of pole loops, which are usually formed with a multifilament in order to increase the proportion of material on the surface and thus the wear volume. Thus, the grip of the edge of the ski is dependent on the angle at which it passes over the gliding surface. This manifests itself in the fact that the turn initiation is not possible with a drifting skiing style with low relief of the ski (especially the outer ski). Accordingly, the edge grip is too great here. In the further course of the turn control, this behavior reverses. Then the edge grip decreases and the outer ski slips away. A similar behavior can be observed in cut turns (carving). The edge characteristics that are always the same on snow are therefore not present. This makes skiing very difficult, especially for beginners.

In the tobogganing area, there is a high risk of injury due to the high floatation and the resulting span between the two points where the yarn dips into the base layer. The yarn of monofilaments or multifilaments extends on the surface of the mat for about 10 mm between the two attachment points in the base layer. If this flat lying yarn (loop height 0 mm) is destroyed in the middle of the yarn by external impact, two open ends of the yarn are created which, due to their continued attachment in the base layer and the associated tension, stand slightly upwards. In practice, an angle of about 20-40° upwards has been observed. The open, destroyed ends of the yarn thus protrude from the actual surface of the mat and form a sharp edge with an increased risk of injury.

The following requirements are analyzed for an improved textile surface for snowless driving with winter sports equipment:

- Manufacture of the complete product (mat with base and functional layer) in one process
- Simple and quick production for covering large areas
- Introducing joining technology to connect individual modules of the mats directly
- in the product (through e.g., overlap points, fastening points).
- Even distribution of contact points to the winter sports equipment in longitudinal and transverse direction
- Fall protection due to soft, closed surface
- Possibility of individual patterning for special usage profiles The present invention is therefore based on the task of meeting these requirements while ensuring cost-effective production and installation of the mats.

According to the invention, the task is solved by the features shown in the claims.

Due to these features, a mat was developed that enables a low coefficient of friction with good guiding properties. The variety of possible combinations offers a wide range of adaptation options for different winter sports.

Due to the high number of pile loops in the functional layer, an even distribution of contact points to the winter sports equipment is possible, even with a low degree floatation. The resulting closed surface is safe even if some yarns of the pile material fail, as no yarns can stand up. This applies above all to the application in the tobogganing sector.

The edging and guiding properties are independent of the laying or driving direction due to the high number of pole loops and the low degree of floatation. The large number of small pile loops enables uniform edge guidance and at the same time a soft and fall-proof surface.

The even edge guidance is achieved by the high number of smaller pile loops. These smaller pole loops are made of a monofilament yarn compared to the multifilament yarn.

This increases the number of contact points with the ski while maintaining the same wear volume on the surface. The higher number of pole loops also allows for a more uniform distribution of the pole loops on the mat. This results in an almost equal number of pole loops engaging the ski, regardless of the angle of the ski to the direction of travel. In turn initiation and turn control, there are no noticeable differences in the force that the mat applies to the ski.

The high number of pole loops constructed from monofilaments results in a softer surface, as a single loop evades a load much more easily than is the case with a loop consisting of multifilament twine. The loop density thus enables a compromise between edge grip and fall safety.

The individual mats can be connected to form larger areas directly via features contained in the material. The loop height can be adjusted in such a way that, for example, a closed surface with the same pole height is created even with overlaps.

These functional properties form the basis for use as a floor covering for use with various winter sports equipment, such as skis, snowboards.

Figure 2:
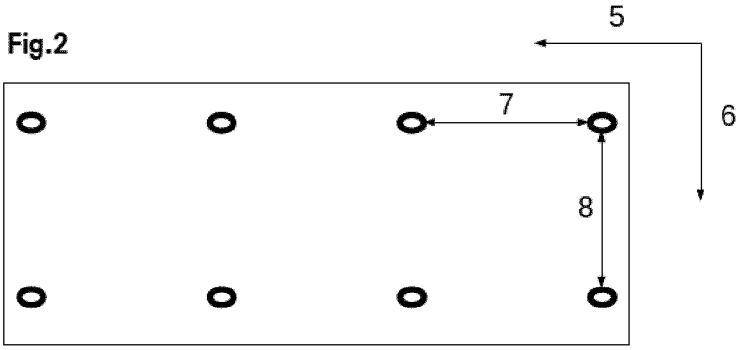

The invention is described in more detail below with reference to the drawings:

Showing:

FIG. 1 a schematic cross-section of the mat;

FIG. 2 a top view of the mat; and

Figure 3:
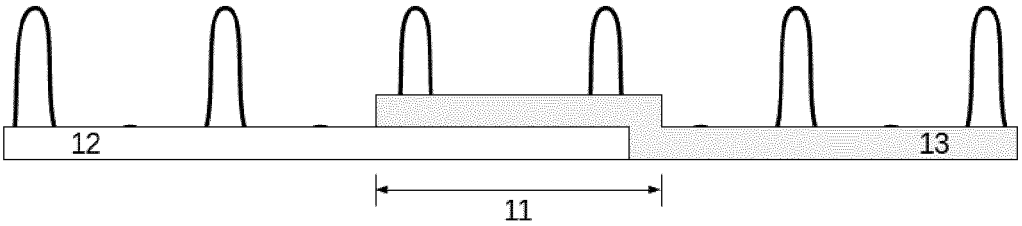

FIG. 3 a schematic cross-section of the joint between the mats.

As shown in the drawings, the textile in a mat consists of a functional layer 1 and a base layer 2.

The functional layer 1 has one or more pile loops 3 made of a fiber or filament yarn of synthetic fibers. These yarns are optimized for friction pairing with the PE coating of the ski. Thus, a snow-like coefficient of friction (also called coefficient of friction) of <0.1 is achieved. According to the invention, a plastic based on PET (polyethylene terephthalate) has proven to be the best friction partner. Other plastics with optimized friction, for example based on PBT (polybutylene terephthalate), PP (polypropylene) or PA (polyamide), can also be used.

The base layer 2 also comprises a textile material and forms a dense fabric (for example by means of a rep weave) which supports the functional layer 1 and stabilizes the pile loops by clamping or binding (between the warp, binder and weft threads) by means of a form fit. For example, a W-binding 10 is used here, which prevents the pile loops of the functional layer from tilting sideways due to another small loop or deflection in the base fabric (W-shaped course of the pile yarn). The pile loops of the functional layer 2 can be designed with a loop height 4 of 0.5 mm to 4 mm (mainly luge application) or 4 mm to 14 mm (ski application) in order to meet the sport-specific requirements. The higher the requirements for edge grip of the alpine ski or cross-country ski, the higher the pole loops should be. Low pole slings are advantageous for tobogganing applications.

A variation of the loop heights 4 is possible both in longitudinal 5 and transverse 6 direction of the textile. The distances between the pile loops (7 & 8) can also be varied between 1.5 mm and 20 mm to form patterns on the surface. This results in a loop density of 400-1200 pile loops/dm$^2$, for toboggan applications even up to 2400 pile loops/dm$^2$.

The material thickness of the pile yarn in the pile loops is 0.5-1.2 mm. Yarns of different thicknesses can be used alternately. For the application in the tobogganing sector and for processing on the machine, for example, the continuous use of yarn of thickness 0.7 mm has proved to be optimal. For optimal edge grip, a mixture of ⅕ monofilament yarn with high thickness (strength) in the range 0.9-1.2 mm and ⅘ monofilament yarn with low thickness 0.5-0.7 mm is used.

By varying the loop heights 4 it is also possible, for the purpose of joining larger areas, both longitudinally 5 and transversely 6, to create an overlap point 11 at the outer edge of a module of the mat where a first mat 12 effectively has no pole loops (or an absolute minimum loop height), while the loop height 4*a* of the second mat 13 is reduced in this area by the thickness of the base layer.

A new production method (weaving technology) makes it possible to produce the multitude of parameters and product properties in one production step. This eliminates the need to rework the fabric to achieve the desired functions, which is familiar from previous products. The possibilities of the machine with regard to fast adjustment of loop height, loop density and patterning, as well as their variation within a product, are optimally utilized. Mat preparations can be implemented up to 4 m. The only restriction on the length of the mat is transport.

The weaving technique enables the production of the complete mat including connection features in one step. Here, only the individual yarns for the fabric are used as the starting material. These can be applied directly to a machine and woven into the mat. Both the base layer 2 and the pile loops 4 of the functional layer 1 are formed in the process. The material of the base layer 2 is mainly unwound from warp beams. The material of the functional layer 1 is preferably obtained from single bobbins for easier patterning and adjustment of the material properties. It is possible to insert several wefts on top of each other, thus creating the possibility of a greater product variety and property integration compared to previously known products, as the layer structure of the base layer 2 is significantly more variable. For the production of the mat including all properties, no further intermediate steps or production steps in pre- or post-processing are necessary.

In the 1st embodiment example, the mat comprises a base fabric 2 based on polypropylene fibers, which are used as binding and filling warp threads, as well as weft threads. The functional layer 1 is a pile fabric made of a monofilament yarn of 100% PET with the following construction parameters:

Yarn thickness 9: 0.7 mm

Loop height 4: 10 mm

Basis weight: 900 g/m2

Loop density: 600/dm$^2$

The mat is used for the ski school application. An underlay, which is additionally placed under the mat for protection against damage and for better drainage, consists of a layer composite of non-woven materials and plastic tangles. The overlapped mats are fastened by means of a metal sheet that is anchored to the subsoil with ground screws. Self-tapping sheet metal screws are screwed into the sheet metal through the overlap 11 of the mats in such a way that the screw heads lie far below the surface of the mat and thus have no influence on the use of winter sports equipment.

In the second embodiment example, the mat also comprises a base fabric based on polypropylene fibers. The functional layer 2 is a pile fabric made of monofilament yarn of 100% PET with the following construction parameters:

Yarn thickness 9: ⅘ of the pole loops 0.7 mm; ⅕ of the pole loops 0.9 mm

Loop height 4: 14 mm

Basis weight 980 g/m2

Loop density: 500 pole loops/dm$^2$.

The mat is used for professional training in skiing. For example, the mat is screwed directly onto a wooden substructure. In this way, the mats can be screwed directly into the base material through the overlap. A connection via a sewn-on Velcro tape or an attached magnetic solution is also conceivable.

In the third embodiment example, the mat comprises a base fabric 2 based on polypropylene fibers. The functional layer 1 is a pile fabric made of monofilament yarn of 100% PET with the following construction parameters:

Yarn thickness (9): 0.7 mm

Loop height (4): 0.7 mm

Basis weight 360 g/m2

1200 pole loops/$dm^2$.

In this example, the mat is used as a toboggan run or run-up track for skis with a separate guide strip, taking advantage of the good trapability of the textile in the mat to mold it into the shape of a guided bobsleigh run and form both the sliding surface and the gang with the same surface. A similar principle is used when used as a classic cross-country ski track.

In addition to screwing, it is also possible to glue the material to various substrates.

The invention claimed is:

1. A textile sliding surface with a functional layer and a base layer, which are connected to one another by filament yarns, the functional layer being formed from pile loops, wherein the pile loops are formed by monofilaments having a thickness in the range 0.5-1.2 mm, and the height of the pile loops in the functional layer are in the range 0.5-14 mm, and wherein the functional layer has 400-2400 pile loops per $dm^2$, and the yarns in the lower part of the pile loops are bound into the base layer by W-bonds.

2. The textile sliding surface according to claim 1, wherein the pile loops in the functional layer have a height in the range 0.5-4 mm and 400-2400 pile loops per $dm^2$.

3. The textile sliding surface according to claim 1, wherein the textile sliding surface is formed of a plurality of mats with the functional layer and the base layer.

4. The textile sliding surface according to claim 3, further comprising an overlap point at which two of the plurality of mats overlap, and wherein the pile loops at the overlap point are at a lower height on one of the mats and substantially no pile loops on the other mat.

5. The textile sliding surface according to claim 1, in which the functional layer is made of a monofilament yarn based on a plastic PET (polyethylene terephthalate), PBT (polybutylene terephthalate), PP (polypropylene) or PA (polyamide).

6. The textile sliding surface according to claim 1, further comprising a backing.

7. The textile sliding surface according to claim 6, wherein the backing is made of a nonwoven fabric or wood.

8. The textile sliding surface according to claim 1, further comprising grooves formed in the functional layer of the sliding surface.

9. A ski or toboggan run made of a textile sliding surface according to claim 1.

* * * * *